US007296388B2

(12) United States Patent
Valentz et al.

(10) Patent No.: US 7,296,388 B2
(45) Date of Patent: Nov. 20, 2007

(54) SKYLIGHT HAVING A MOLDED PLASTIC FRAME

(76) Inventors: Arthur J. Valentz, 98 Pipers Walk, Sugar Land, TX (US) 77479; John E. Nemazi, 4373 Stoneleigh, Bloomfield Hills, MI (US) 48302; James W. Proscia, 3601 Brewster Rd., Dearborn, MI (US) 48120

( * ) Notice: Subject to any disclaimer, the term of this patent is extended or adjusted under 35 U.S.C. 154(b) by 673 days.

(21) Appl. No.: 10/639,410

(22) Filed: Aug. 12, 2003

(65) Prior Publication Data

US 2005/0055901 A1 Mar. 17, 2005

(51) Int. Cl.
*E04C 3/30* (2006.01)

(52) U.S. Cl. ..... 52/733.2; 52/200; 52/203

(58) Field of Classification Search ..... 52/22, 52/200, 64, 733.2, 203
See application file for complete search history.

(56) References Cited

U.S. PATENT DOCUMENTS 3,434,251 A 3/1969 Kiekhaefer
4,114,330 A 9/1978 Sukolics
4,173,854 A 11/1979 Wallerstein
4,193,237 A 3/1980 Jankowski
4,223,493 A 9/1980 Moench et al.
4,296,578 A * 10/1981 Keckman ..... 52/200
4,333,295 A 6/1982 Janke
4,389,823 A 6/1983 Player
4,408,422 A 10/1983 Bechtold
4,439,962 A 4/1984 Jentoft et al.
4,470,230 A 9/1984 Weisner
4,520,604 A 6/1985 Halsey et al.
4,527,368 A 7/1985 Jentoft
4,548,006 A 10/1985 Roberts, Sr.
4,549,379 A 10/1985 Hoy et al.
4,589,238 A 5/1986 Sampson et al.
4,594,821 A 6/1986 Bechtold et al.
4,610,116 A 9/1986 Schulz
4,649,680 A 3/1987 Weisner et al.
4,685,256 A 8/1987 Alkjaer
4,702,049 A 10/1987 Sampson et al.
RE32,539 E 11/1987 Jentoft et al.
4,703,592 A 11/1987 Sampson et al.
4,730,426 A 3/1988 Weisner et al.
4,750,302 A 6/1988 Bechtold
4,762,160 A 8/1988 Bechtold et al.
4,788,804 A 12/1988 Haas
4,796,400 A 1/1989 Mulder (Continued)

*Primary Examiner*—Basil Katcheves
(74) *Attorney, Agent, or Firm*—Brooks Kushman P.C.

(57) ABSTRACT

The present invention provides a skylight frame design that is adapted to receive at least two panels of glass. The skylight frame comprises a stepped frame section that includes a lower step surface and an upper step surface. The lower step surface is adapted to receive a first glass panel so that a section of the first glass panel lies flush against the lower step surface. Similarly, the upper step surface is adapted to receive a second glass panel so that the second glass panel lies flush against the upper step surface. The skylight frame design of the invention is either incorporated into a skylight frame that may be attached to a curb unit on a roof or it may be an integral part of a skylight frame-curb assembly that also contains a curb section. In another embodiment of the invention, a skylight frame design which directly incorporates one or more panels of glass during molding is provided.

14 Claims, 17 Drawing Sheets

U.S. PATENT DOCUMENTS

| | | | | |
|---|---|---|---|---|
| 4,825,608 | A | | 5/1989 | Makin |
| 4,830,038 | A | | 5/1989 | Anderson et al. |
| 4,860,511 | A | | 8/1989 | Weisner et al. |
| 4,884,379 | A | | 12/1989 | McCabe |
| 4,896,468 | A | | 1/1990 | Sampson et al. |
| 4,924,649 | A | | 5/1990 | Taylor |
| 4,926,594 | A | | 5/1990 | Sampson et al. |
| 4,928,445 | A | | 5/1990 | Sampson et al. |
| 4,930,274 | A | | 6/1990 | Cummings et al. |
| 4,930,275 | A | | 6/1990 | Verby et al. |
| 4,941,302 | A | | 7/1990 | Barry |
| 4,952,430 | A | | 8/1990 | Bowser et al. |
| 4,986,039 | A | | 1/1991 | Weisner |
| 4,987,705 | A | | 1/1991 | Sampson et al. |
| 4,995,208 | A | | 2/1991 | Sampson et al. |
| 5,008,062 | A | | 4/1991 | Anderson et al. |
| 5,044,133 | A | | 9/1991 | Sampson et al. |
| 5,046,292 | A | | 9/1991 | Sampson et al. |
| RE33,720 | E | | 10/1991 | Cummings |
| 5,061,531 | A | | 10/1991 | Catalano |
| 5,092,089 | A | | 3/1992 | Kessler |
| 5,103,603 | A | | 4/1992 | Verby et al. |
| 5,148,643 | A | | 9/1992 | Sampson et al. |
| 5,199,234 | A | | 4/1993 | Guhl |
| 5,207,036 | A | | 5/1993 | Sampson et al. |
| 5,237,788 | A | | 8/1993 | Sandow |
| 5,291,705 | A | | 3/1994 | Dickerson |
| 5,323,576 | A | | 6/1994 | Gumpert et al. |
| 5,394,664 | A | | 3/1995 | Nowell |
| 5,419,090 | A | | 5/1995 | Sandow |
| 5,502,934 | A | | 4/1996 | Coyne et al. |
| 5,528,471 | A | | 6/1996 | Green |
| 5,544,455 | A | | 8/1996 | DeBlock |
| 5,581,971 | A | | 12/1996 | Peterson |
| 5,617,682 | A | | 4/1997 | Christopher |
| 5,640,828 | A | | 6/1997 | Reeves et al. |
| 5,675,940 | A | | 10/1997 | Bahar et al. |
| 5,715,634 | A | | 2/1998 | Schultz |
| 5,765,324 | A | | 6/1998 | Schultz |
| 5,778,629 | A | | 7/1998 | Howes |
| 5,784,853 | A | * | 7/1998 | Hood et al. ..... 52/786.13 |
| 5,806,255 | A | | 9/1998 | Verby et al. |
| 5,913,785 | A | | 6/1999 | Moller et al. |
| 6,052,956 | A | | 4/2000 | Hoy et al. |
| 6,138,433 | A | | 10/2000 | Ridge |
| 6,172,295 | B1 | | 1/2001 | Hattori et al. |
| 6,263,624 | B1 | | 7/2001 | Hoy et al. |
| 6,378,586 | B1 | | 4/2002 | Lafond |
| 6,418,679 | B2 | | 7/2002 | Widmer |
| 7,049,803 | B2 | | 5/2006 | Dorner et al. |

* cited by examiner

SKYLIGHT HAVING A MOLDED PLASTIC FRAME

BACKGROUND OF THE INVENTION

1. Field of the Invention

The present invention relates to a skylight having a plastic frame.

2. Background Art

Skylights have been used to allow light into residential and commercial buildings through an opening. The aesthetic value and possible health benefits of having sunlight in buildings have lead to an increasing demand for these structures. Ideally, a skylight will let light in while keeping other environmental elements out. However, since the installation of a skylight requires that an opening be cut in a roof, sealing such units has presented numerous challenges.

Popular skylight configurations include, for example, fixed skylights with flat or domed-shaped glass, ventilation skylights, egress skylights, and balcony skylights. In the fixed skylight configuration, the skylight functions essentially as a window that does not open. Ventilation skylights are similar, but may be opened a few inches to allow air circulation. Ventilation skylights may be opened by a pole or by a small electric motor. Egress roof skylights are capable of being opened by a sufficient amount for a person to move through. Balcony roof skylights which are usually installed on relatively steep roofs open to form a small balcony on which a person may stand.

In the typical fixed skylight installation a rectangular opening is cut in a roof. This opening will go through the plywood sheets in the roof. A curb unit is then attached to the plywood sheets of the roof. The external curb surfaces are then flashed with either roof boards or metal sheets to provide a leak-tight seal between the curb and roof. The skylight frame is then attached to the top surface of the curb unit. The skylight frame will usually have one or more glass panels surrounded by an aluminum trim frame. The glass panels are separated by a spacer which seals the interior cavity between the panels. The configuration for the glass panels is the same as that typically used in insulated window constructions. Transparent plastic panels may be used instead of glass panels. Additionally, the panels may be domed-shaped if desired. Such curbs are usually made of wood with a metal flashing along the sides of the curb. Generally, these curbs are fabricated on-site during the installation of the skylight. For stationary skylights, a leak tight seal will be formed between the skylight and the curb. Over time this leak tight seal often degrades and leaks. Furthermore, the application of a sealant to the curb may cause complications with the skylight manufacture tolerances by leaving a space between the metal flashing along the sides of the curb and the top of the curb. Foamed tapes have been used in place of sealants. However, such tapes do not adhere as well as sealants. Gaskets have been applied to both seal the skylight frame to a curb and to file the space between the metal flashing and the curb. Such configurations tend to be expensive and require rather strict tolerances. Moreover, the gasket can not be modified on-site.

Skylights have been formed with components made by reaction injection molding ("RIM"). U.S. Pat. No. 5,061,531 ("the '531 patent") discloses a framed insulating glass unit with an integral skylight frame and an integral curb made by the RIM process. In the framed insulating glass unit of the '531 patent, two glass plates are molded into a frame member by a polyurethane RIM process. RIM is a process of molding plastic parts using liquid monomers. It is capable of forming solid or foam parts that can vary from being flexible to extremely rigid. Polyurethanes are probably the most common plastics from which parts are made by the RIM process. RIM polyurethane is made by combining an isocyanate and a polyol.

In the typical RIM process, the liquids are pumped into and combined in a mixer under a pressure between about 1,500 and 3,000 psi. The liquids are then introduced into the mold under a low pressure (about 1 atm). An exothermic chemical reaction occurs in the mold causing the liquid to solidify without heating or cooling. Parts fabricated by RIM offer several advantages over other molding processes. Although parts produced by RIM are similar to parts made by injection molding, RIM parts may be made with shorter production time and less cost. Furthermore, RIM does not require high temperatures or pressures typical of injection molding thereby making it possible to make the molds out of inexpensive materials such as aluminum. However, the RIM process presents a number of considerations that complicates part fabrication. For example, the processing temperature, pressure and viscosity must be accurately controlled since the polymerization of the monomers takes place in the mold. Furthermore, the mixing head must be completely purged after each part is formed to prevent clogging. Finally, the relatively protracted cycle times for forming larger parts and the limited choices of polymers (mostly polyurethanes) make RIM a somewhat undesirable process.

Accordingly, there exists a need for an improved skylight that is inexpensive to fabricate with a minimal number of seamed junctions.

SUMMARY OF THE INVENTION

The present invention overcomes the prior art by providing a skylight frame-curb assembly adapted to receive at least two panels of glass. The skylight frame-curb assembly of the present invention comprises a quadrilateral frame and a stepped frame section that is integral to the quadrilateral frame. The stepped frame surface includes a lower step surface and an upper step surface. The lower step surface is adapted to receive a first glass panel so that a section of the first glass panel lies flush against the lower step surface. Similarly, the upper step surface is adapted to receive a second glass panel so that the second glass panel lies flush against the upper step surface. The first glass panel is characterized by a first length and a first width and the second glass panel is characterized by a second length and a second width, such that the first length is less than the second length and the first width is less than second width. The first and second glass panels are advantageously combined together in an insulated glass unit. The frame curb assembly further includes a curb section which is integral to the quadrilateral frame. The curb section includes a surface that is adapted to lie on a roof to which it is flashed in a leak tight manner by methods known to one skilled in the art of skylight installation.

In another embodiment of the invention, a skylight frame adapted to be attached to a curb is provided. The skylight frame includes a stepped frame section including a lower step surface and an upper step surface. Again, the lower step surface is adapted to receive a first glass panel so that a section of the first glass panel lies flush against the lower step surface. Similarly, the upper step surface is adapted to receive a second glass panel so that the second glass panel lies flush against the upper step surface. The first and second glass panels are advantageously combined together in an insulated glass unit.

In another embodiment of the present invention, a skylight frame-curb assembly having a U-shaped trough with a mounting flange extending from one side of the U-shaped trough is provided. The skylight frame-curb assembly of this embodiment also includes the stepped frame section as described above. The trough of the present embodiment is filled with a foamed plastic in order to provide rigidity while reducing the weight of the skylight frame-curb assembly.

In another embodiment of the present invention, a skylight frame having one or more central support members is provided. The sides of the frame of this embodiment also include the stepped frame section described above. The one or more central support members include a lower step surface for receiving a lower glass panel. In this embodiment several lower glass panels are mounted between the lower step surfaces of the sides and the central support member. The upper glass surface in this design is a single glass panel which is received by the upper step surface of the sides. The upper glass panel also rests on the upper surface of the central support member.

In another embodiment of the present invention, a skylight frame-curb assembly fabricated by the RIM process is provided. In this embodiment, one or more glass panels are molded into the skylight frame section during formation of the skylight frame. The skylight frame assembly includes a frame section with slot adapted to hold one or more glass panels.

In still another embodiment of the present invention, an injection molded skylight curb unit is provided. The skylight curb unit includes four hollow sides that define a substantially rectangular or square opening. A flexible apron extends outwardly from the sides to provide a surface that is adapted to be placed on a rooftop. The side of the apron opposing the roof may be sealed to the roof and the entire apron flashed to a roof by methods known to those in the art of skylight installation.

In yet another embodiment of the present invention, a method of making a skylight frame is provided. The method of this embodiment comprises extruding a plastic channel with a stepped frame section integral to a lower curb portion. The frame section is similar to that set forth above. The plastic channel is then cut into four side sections which are then combined together to form the skylight frame.

DETAILED DESCRIPTION OF THE PREFERRED EMBODIMENTS

Reference will now be made in detail to presently preferred compositions or embodiments and methods of the invention, which constitute the best modes of practicing the invention presently known to the inventors.

In an embodiment of the present invention, a skylight frame-curb assembly adapted to receive at least two panels of glass is provided. The skylight frame-curb assembly of the present invention comprises a quadrilateral frame with an integral stepped frame section. The quadrilateral frame is preferably substantially rectangular. The stepped frame surface includes a lower step surface and an upper step surface. The lower step surface is adapted to receive a first glass panel so that a section of the first glass panel lies flush against the lower step surface. Similarly, the upper step surface is adapted to receive a second glass panel so that the second glass panel lies flush against the upper step surface.

Figure 1:
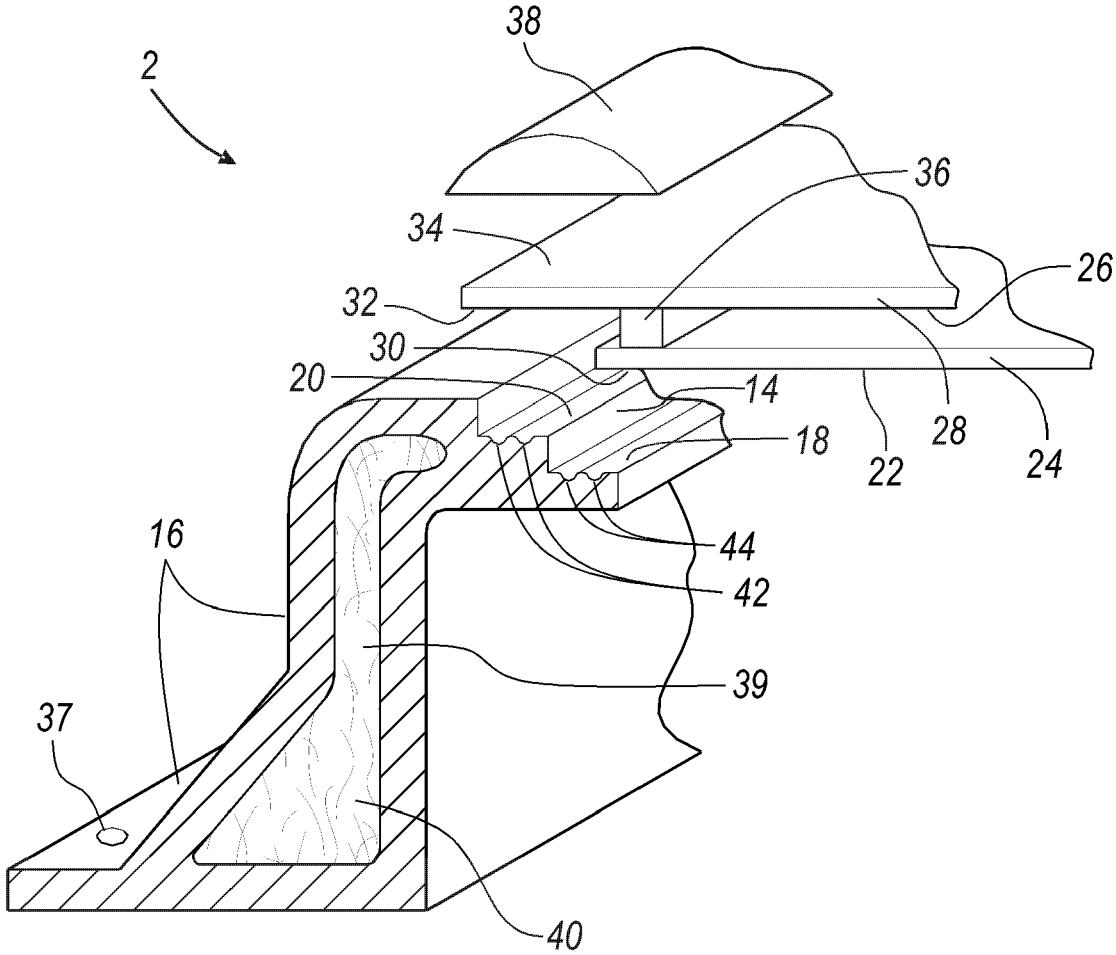
FIG. 1 is a perspective cross-sectional view of the skylight frame-curb assembly of the present invention.
Figure 2:
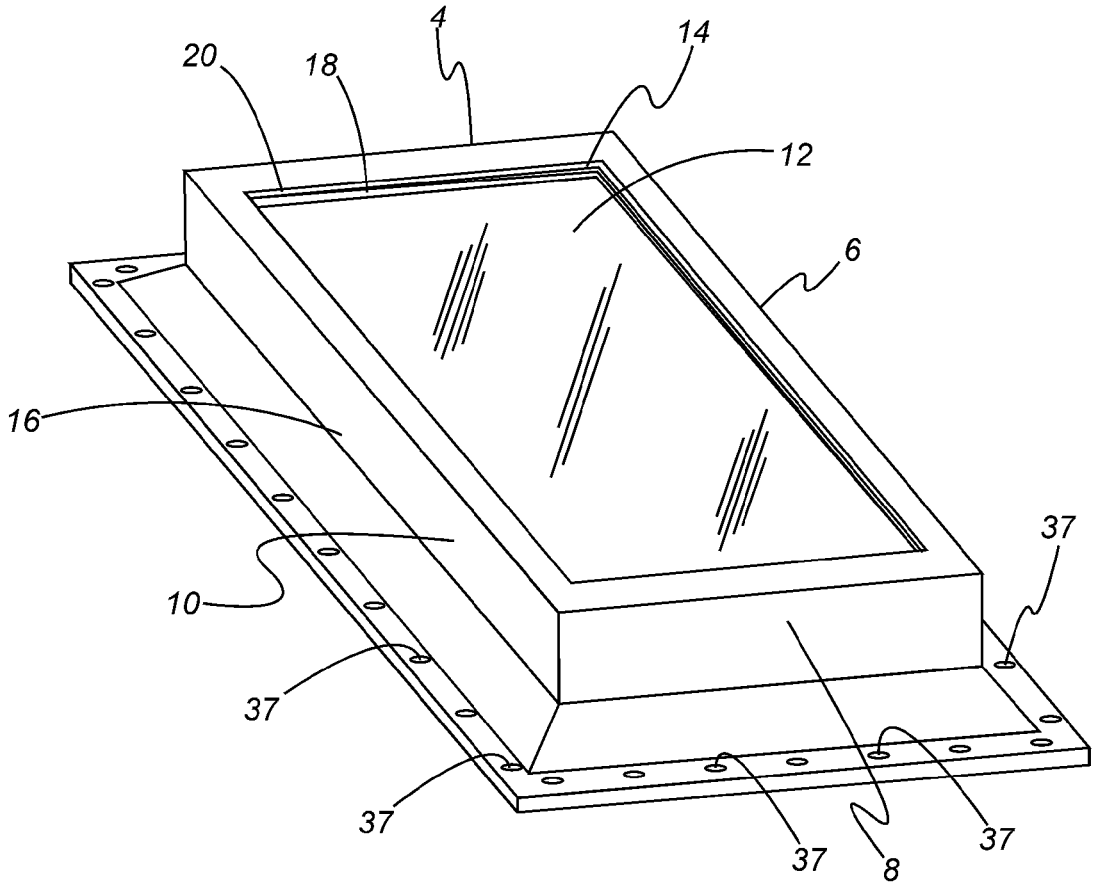
FIG. 2 is a perspective view of the skylight frame-curb assembly of the present invention.

With reference to FIGS. 1 and 2, a perspective view of a cross-section and a top view of the skylight frame-curb assembly of the present invention is provided. Skylight frame-curb assembly 2 includes sides 4, 6, 8, 10 which define opening 12. Opening 12 is of appropriate size to line up with a skylight opening curb into a roof. Sides 4, 6, 8, 10 each include stepped frame section 14 and curb section 16 which are integral to skylight frame-curb assembly 2. Stepped frame section 14 includes lower step surface 18 and an upper step surface 20. Lower step surface 18 is adapted to receive glass surface 22 of glass panel 24 and upper step surface 20 is adapted to receive glass surface 26 of glass panel 28. Specifically, glass peripheral surface 30 opposes lower step surface 18 and glass peripheral surface 32 opposes upper stepped surface 20. Glass panel 24 is characterized by a first length and a first width and glass panel 28 is characterized by a second length and a second width, such that the first length is less than the second length and the first width is less than second width. Preferably, glass panel 24 and glass panel 28 are combined together in insulated glass unit 34 with a spacer 36. Alternatively, glass panel 24 and glass panel 28 are laminated together like an automobile windshield. Suitable laminates include, for example, polyvinylbutyral. Lamination of glass panels 24, 28 provide added protection from glass breakage. Stepped frame section 14 corresponds in shape to the edge detail and thickness of the insulating glass unit (or the laminated glass unit) so that the insulating glass unit is mounted flush.

The skylight of the present design lends itself to a wide array of aesthetic appearances. The insulated glass units can be fabricated using colored glass to achieve a desired color and thermal properties. Alternatively, one or more surfaces of glass panels 24 and 28 may be coated with thin films to alter the appearance of the skylight or to provide solar control properties. For example, in northern climates a low E coating is applied to one or more of the glass surfaces. In southern climates, reflective coatings capable of rejecting 80-90% of the radiant energy could be utilized to minimize air conditioning costs. Furthermore, the color of the glass panel on the peripheral portion can be selected to provide the desired aesthetic appearance. Curb section 16 optionally includes a number of bolt holes 37 so that skylight frame curb assembly 2 may be attached to a roof. During installation, curb section 16 will be flashed to the roof by methods known to those skilled in the art of skylight installation. Skylight frame-curb assembly 2 optionally includes trim strip 38 which can be provided at the overlap of insulated glass unit 34 and skylight frame-curb assembly 2.

Skylight frame-curb assembly 2 may be formed from any suitable material which supplies suitable mechanical stiffness and resistance to deterioration from environment factors such as temperature, humidity, sun light, air, rain, snow, hail, and the like. Suitable materials include for example various plastics, wood, and metals. The preferred materials are plastics and in particular thermoplastic resins such as polyvinylchloride, polyethylene, polypropylene, or nylon. When a plastic is utilized to mold skylight frame-curb assembly 2 a glass fiber reinforcement filler may be used in the plastic composition selected in order to minimize the thermal expansion of skylight frame-curb assembly 2. Skylight frame-curb assembly 2 may be formed by a number of different molding processes. For example, skylight frame-curb 2 may be formed by injection molding, vacuum molding, compression molding, or by RIM. The preferred molding process is chosen to improve strength and to minimize part weight and to provide optimum thermal insulation qualities. To this end, skylight frame-curb assembly 2 optionally includes one or more hollow cores 39 that may be filled with foamed plastic 40. Skylight frame-curb assemblies with hollow cavities may be made by gas assisted injection molding which uses a conventional injection molding press equipped with a spillover control and a mold equipped with gas injection and spillover points. Suitable gas assisted injection molding processes which may be used to form the skylight frame-curb assembly of the present invention are described in U.S. Pat. No. 6,019,918. The entire disclosure of this patent is hereby incorporated by reference. The foam material is then introduced through inlet holes after the frame is molded. Alternatively, the part can be molded utilizing a plastic foaming agent, the surface of the plastic part having a smooth uniform skin while the inner core contains a series of gas bubbles forming a rigid foam or sponge-like core. The skylight frame-curb assembly may also be made by compression molding using either sheet molding compound ("SMC") or bulk molding compound.

Insulating glass unit 34 is bonded to stepped flange section 14 of skylight frame-curb assembly 2 utilizing adhesives in a manner similar to mounting a flush glazed windshield in an automobile. Preferably, glass surface 26 of the glass panel 28 has a peripheral edge painted to provide an aesthetic detail as well as improve the adhesion of the bond between the glass pane 28 and frame curb assembly 2. Optionally, grooves 42, 44 may be formed on lower step surface 18 and upper step surface 20 in order to provide a relatively thick bead of adhesive in order to accommodate some slight relative movement due to the differential thermal expansion of insulated glass unit 34 in order to further minimize the mold expansion problems.

Figure 3:
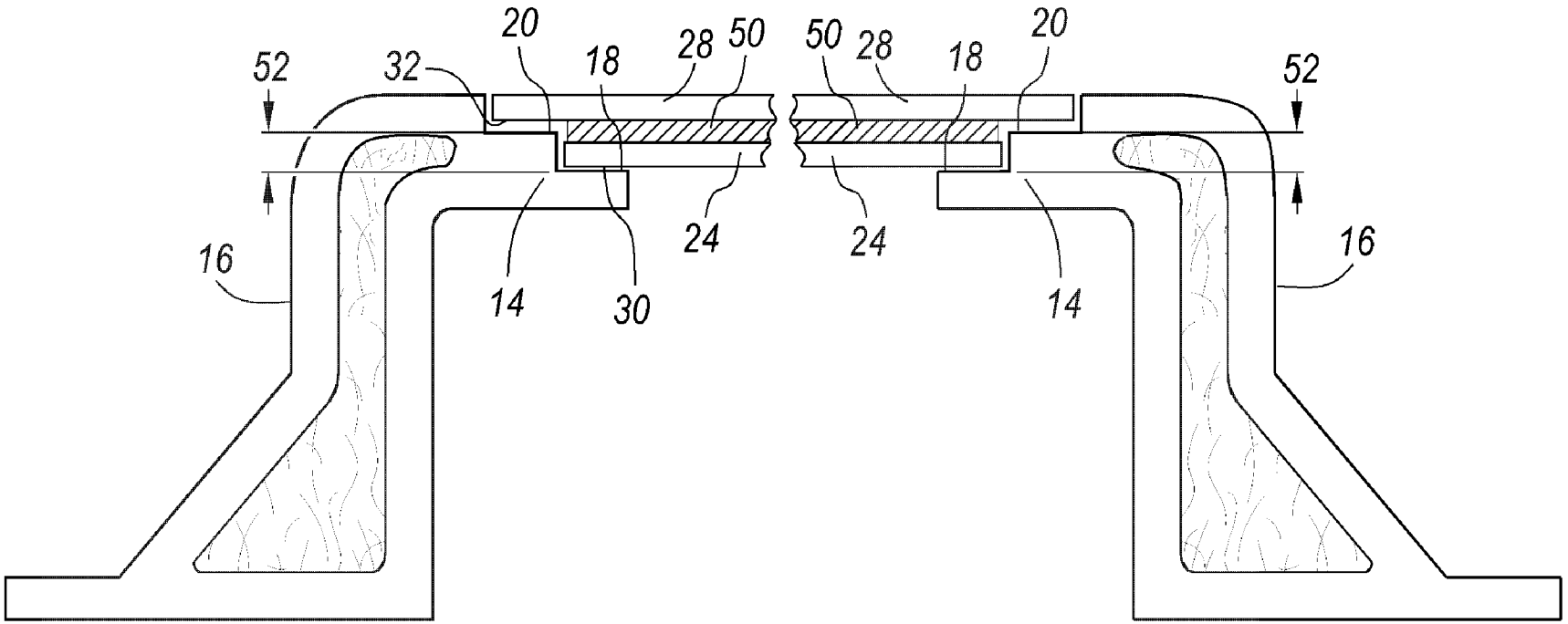
FIG. 3 is a cross-section of a skylight frame-curb assembly of the present invention with an attached laminated glass sheet.

With reference to FIG. 3, a cross-section of a skylight frame-curb assembly with an attached laminated glass sheet is provided. In this variation glass panel 24 and glass panel 28 are laminated together with laminate layer 50. Glass panel 28 is slightly larger than glass panel 24. Glass edge 30 opposes lower step surface 18 and glass edge 30 opposes upper stepped surface 20. In this variation, height 52 must be of appropriate dimensions to allow an effective seal when an adhesive is applied to lower set surface 18 and upper step surface 20. Generally, height 52 will be several millimeters.

Figure 4:
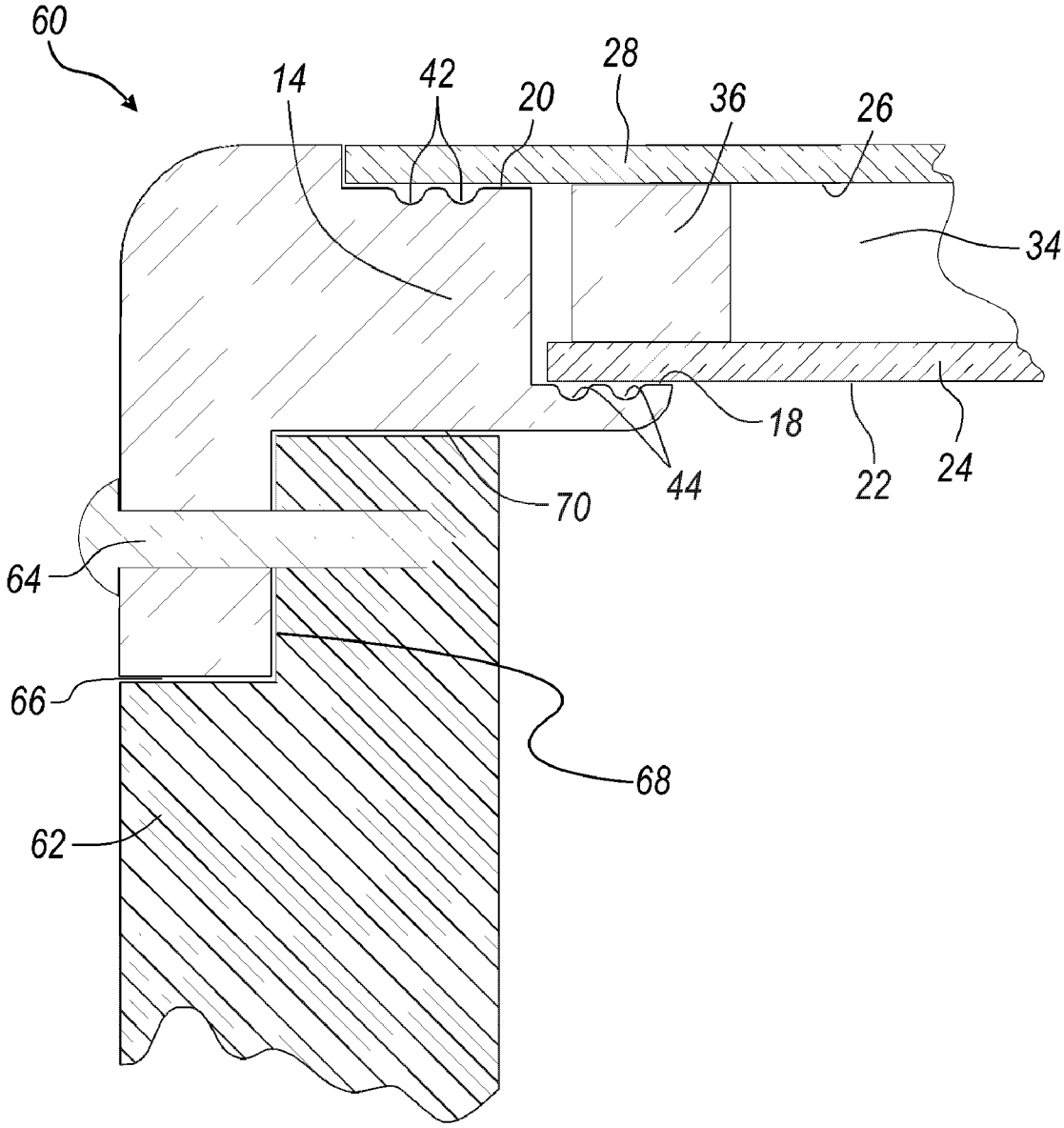
FIG. 4 is a cross-sectional view of an embodiment of the present invention in which the stepped frame section is on a separate part from the curb.

With reference to FIG. 4, a cross-sectional view of an embodiment of the present invention in which the stepped frame section is on a separate part from the curb is provided. Frame 60 includes stepped frame section 14 which is the same as set forth above. Stepped frame section 14 includes lower step surface 16 and upper step surface 20. Lower step surface 18 is adapted to receive glass surface 22 of glass panel 24 and upper step surface 20 is adapted to receive glass surface 26 of glass panel 28. Glass panel 24 is characterized by a first length and a first width and glass panel 28 is characterized by a second length and a second width, such that the first length is less than the second length and the first width is less than second width. Preferably, glass panel 24 and glass panel 28 are combined together in insulating glass unit 34 or a laminated glass unit as set forth above. Frame 60 may be formed from the same materials and by the same molding processes as set forth above. Frame 60 is attached to curb 62. This attachment may be accomplished by means known to one skilled in the art of skylight installation. Preferably, frame 60 is bolted to curb 62 by bolts 64. Optionally, a sealant may be placed on one or more of seams 66, 68, 70 to reduce the possibility of water leaking from the skylight. The frame assembly of this embodiment allows insulated glass unit 34 and frame 60 to be replaced in the event a window is damaged during or after construction. This is to be contrasted with a damaged insulated glass unit for the design of FIGS. 1 and 2, which would require replacement in a manner similar to the replacement of an automobile windshield. The two piece design of the present embodiment enables a less skilled person to do the window replacement by unbolting frame 60 and replacing the whole unit—frame 60 and insulated glass unit 34. Moreover, insulated glass unit and frames can be made standard sizes and matched up with curbs of a selected height and thermal quality for the specific market.

Figure 5:
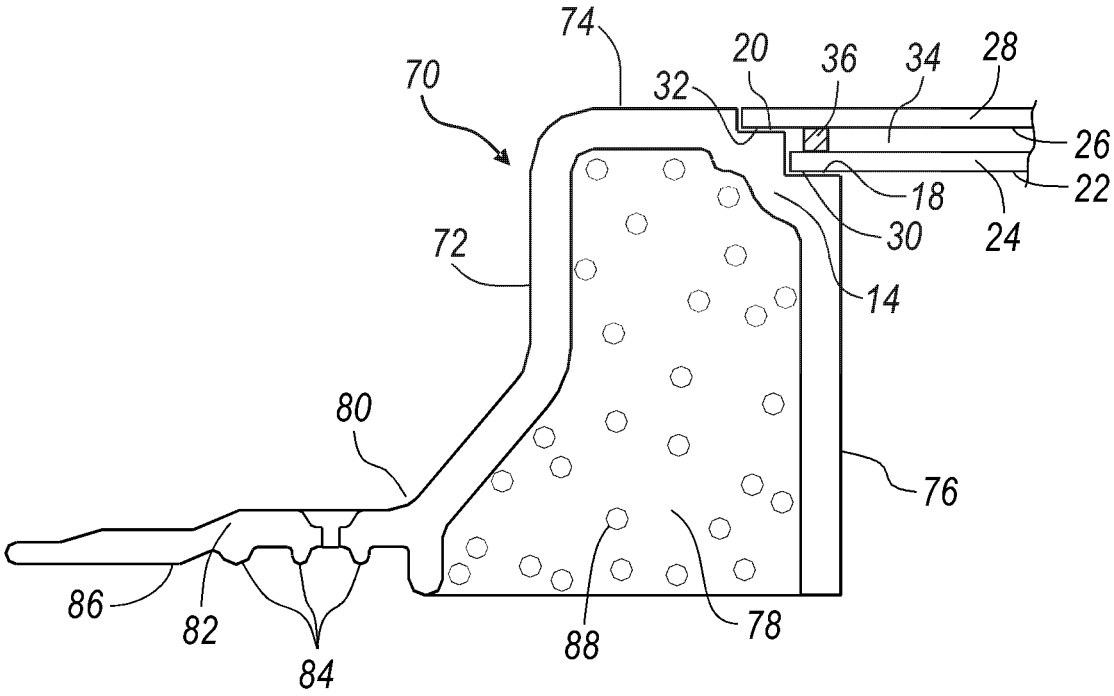
FIG. 5 is a cross-sectional view of an embodiment of the present invention in which the frame curb assembly has a U-shaped trough with a mounting flange extending from one side of the U-shaped trough.

With reference to FIG. 5, a cross-section of another embodiment of the present invention in which the frame curb assembly has a U-shaped trough with a mounting flange extending from one side of the U-shaped trough is provided. Skylight frame-curb assembly 70 includes stepped frame section 14. As set forth above, stepped frame section 14 includes lower step surface 18 and upper step surface 20. Again, lower step surface 18 is adapted to receive glass surface 22 of glass panel 24 and upper step surface 20 is adapted to receive glass surface 26 of glass panel 28. Glass panel 24 is characterized by a first length and a first width and glass panel 28 is characterized by a second length and a second width, such that the first length is less than the second length and the first width is less than second width. Preferably, glass panel 24 and glass panel 28 are combined together in insulated glass unit 34 with a spacer 36. Skylight frame-curb assembly include sides 72, 74, 76 which define trough 78. Curb section 80 includes mounting flange 82 which extends from the bottom of side 72. Ribs 84 extend from bottom surface 86 of mounting flange 82 to provide stiffness. Skylight frame-curb assembly 70 may be formed by the same molding processes as described above which include injection molding from thermoplastic resins or by RIM. After skylight frame-curb assembly 70 is molded, trough 78 is filled with foamed plastic 88 in a second operation. Foamed plastic 88 provides rigidity to skylight frame-curb assembly 70 as well as good thermal insulation. Glass panels 24, 28 are installed in a similar manner to the installation of an automobile windshield. Accordingly, an adhesive is applied between glass edge 30 and lower step surface 18 and between glass edge 32 and upper stepped surface 34.

Figure 6:
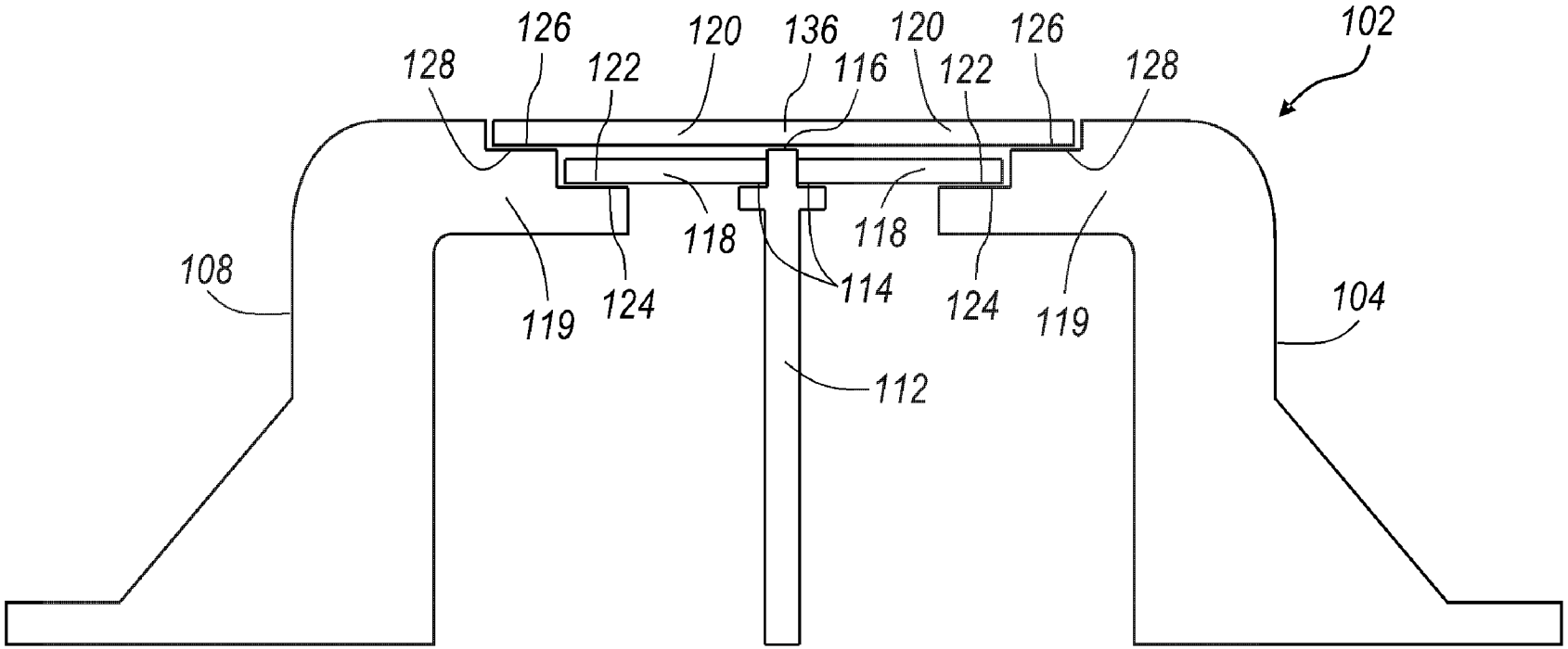
FIG. 6 is a cross-sectional view of an embodiment of the present invention utilizing a central cross member.
Figure 7:
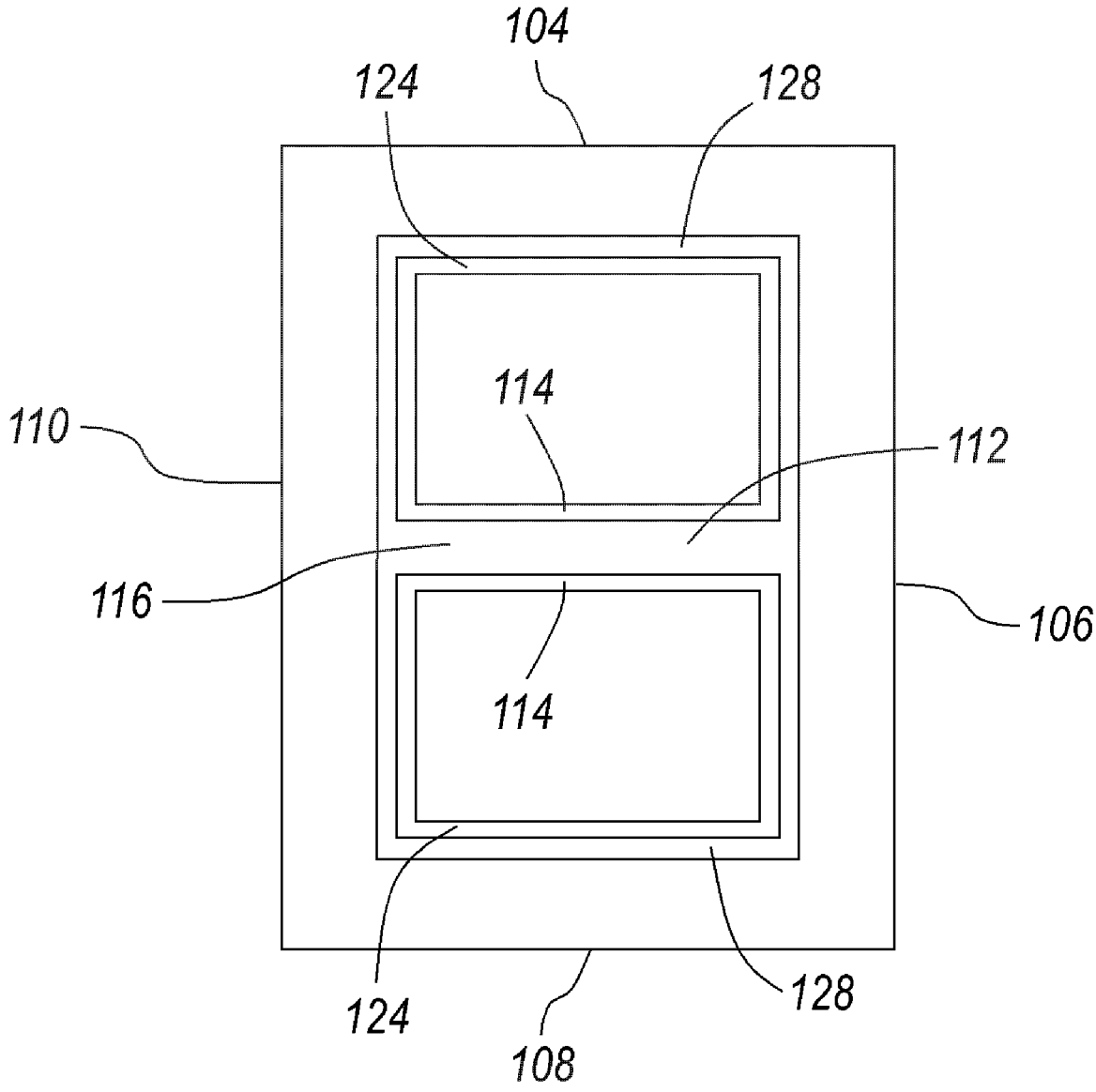
FIG. 7 is a top view of an embodiment of the present invention utilizing a single central cross member.

With reference to FIGS. 6 and 7, cross sectional and top views of various frame assemblies utilizing a central cross member of an embodiment of the present invention in which a series of frame configurations having a central cross member for supporting multiple insulating glass units in a single frame is provided. FIG. 6 provides a cross-section of the present embodiment in which a central cross member is utilized. FIG. 7 provides a top view of the assembly illustrated in FIG. 6. Skylight frame 102 includes side sections 104, 106, 108, 110 and central cross member 112. Side sections 104, 106, 108, 110 each include stepped frame section 14 which has described above. Cross member 112 include cross member step section which has lower step surface 114 and top surface 116. Skylight frame includes stepped frame section 119 which has been set forth above. In this configuration, glass panels 118, 120 are placed in skylight frame 102 such that a peripheral section of glass surface 122 opposes lower step surfaces 124 and lower step surfaces 114. Larger glass panel 120 is positioned in frame 102 such that a peripheral section of surface 126 opposes upper step surfaces 128. Central portion 136 of glass panel 126 lies on and is supported by top surface 116 of cross member 112. The frame assemblies of the present embodiment allows large skylights to be fabricated and ganged together to form large panels of minimal viewing area blocked by cross members of structural supports. Because the outside surface of the skylight assembly is made from a single piece of glass the outside appearance is substantially uniform.

Figure 8A:
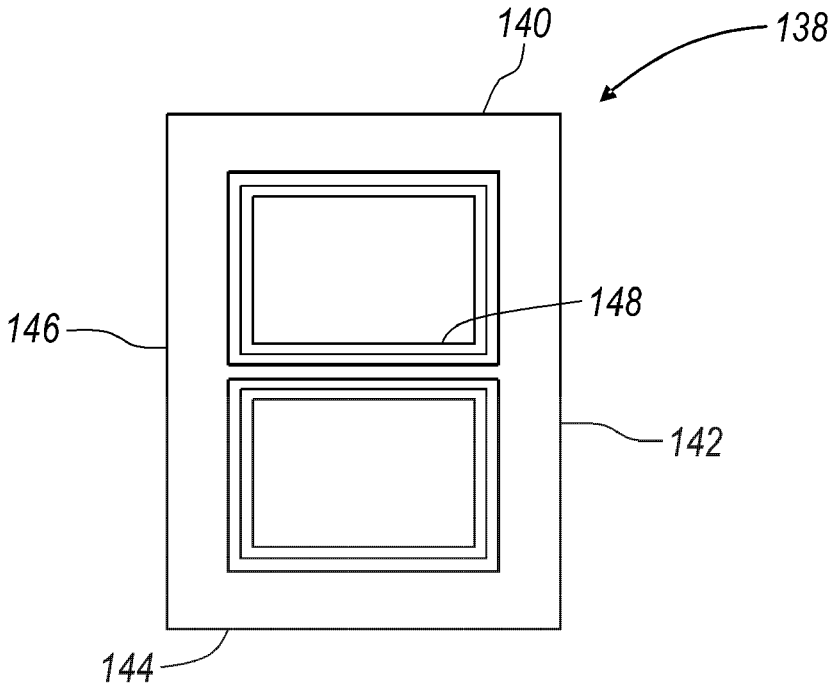
FIG. 8A is a top view of an embodiment of the present invention utilizing a two step cross member.
Figure 8B:
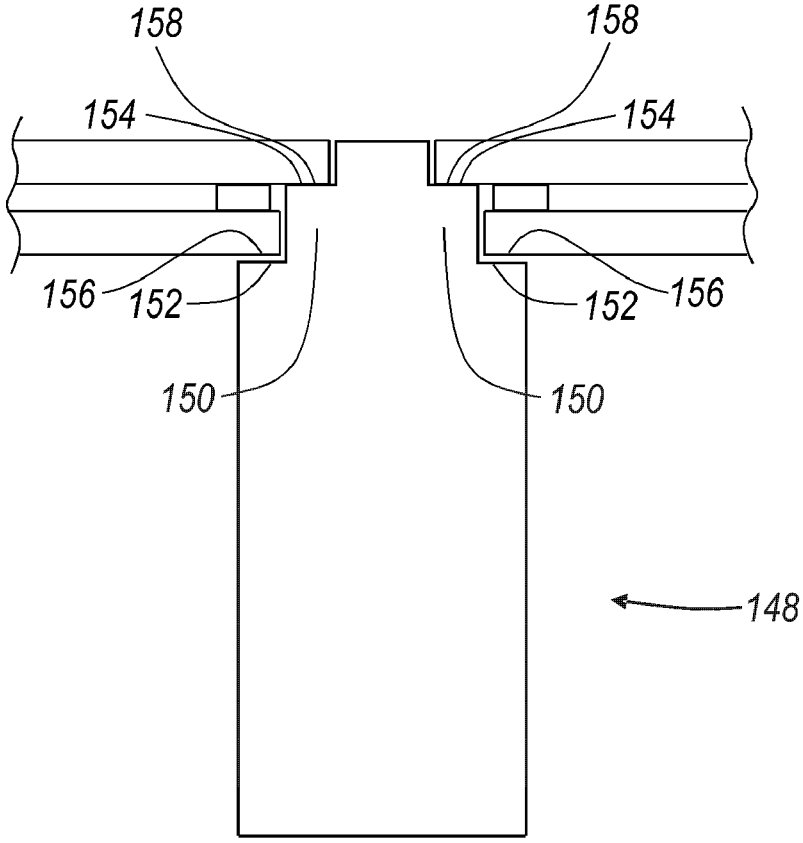
FIG. 8B is a cross-sectional view of the two step cross member illustrated in FIG. 8A.

With reference to FIGS. 8A and 8B, an alternative design for a skylight with one or more cross members is provided. FIG. 8A provides a top view of this embodiment utilizing a two step cross member, while FIG. 8B is a cross section of the cross member used in this embodiment. In this variation, frame 138 includes sides 140, 142, 144, 146 and cross members 148. Each of sides 140, 142, 144, 146 include a stepped frame section as set forth above. FIG. 8B provides a cross section of the two step cross member of the present invention. Cross member 148 includes stepped frame sections 150 with lower step surface 152 and upper step surface 154. Glass surface 156 opposes lower step surface 152 and glass surface 158 opposes upper step surface 154 in a similar manner as described in the discussion of FIGS. 1 and 2.

Figure 9:
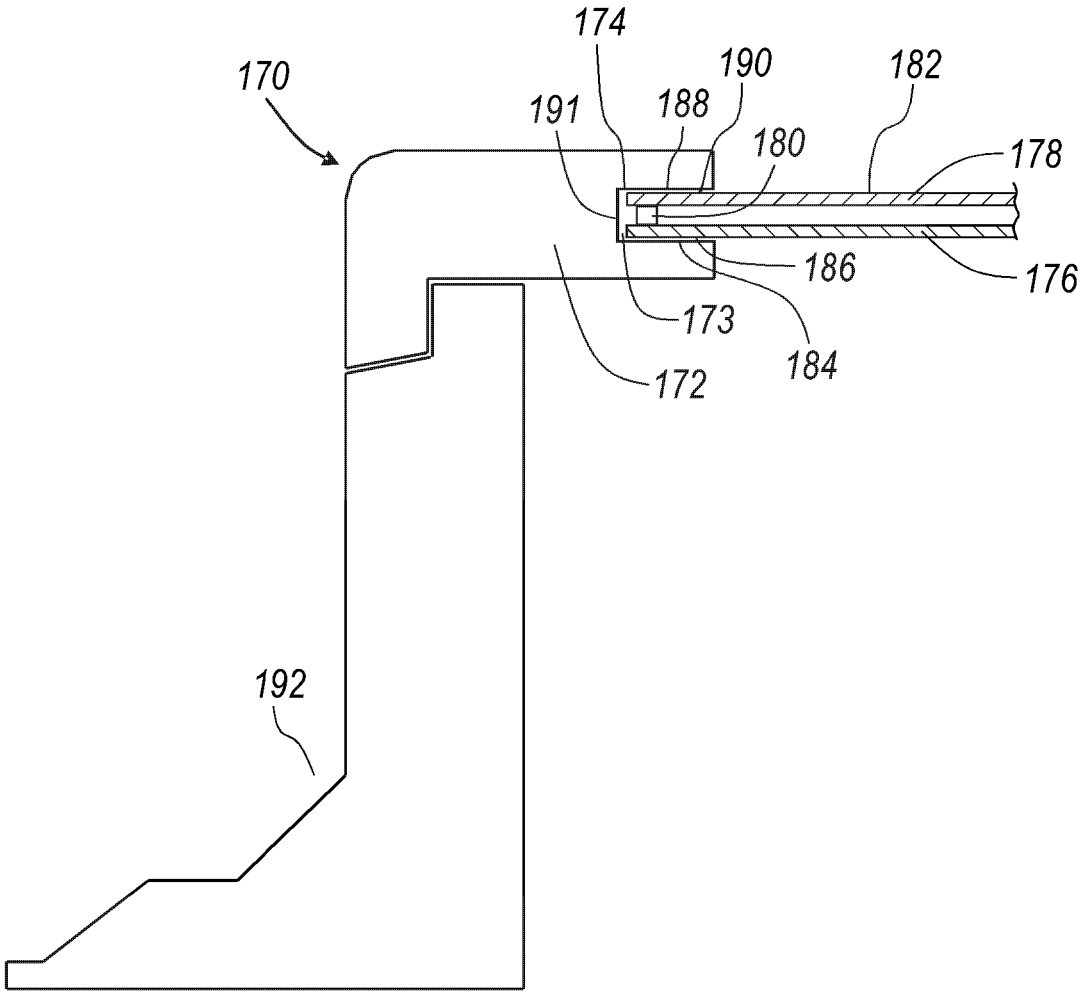
FIG. 9 is a cross-sectional view of a skylight frame-curb assembly of the present invention made by reaction injection molding.
Figure 10:
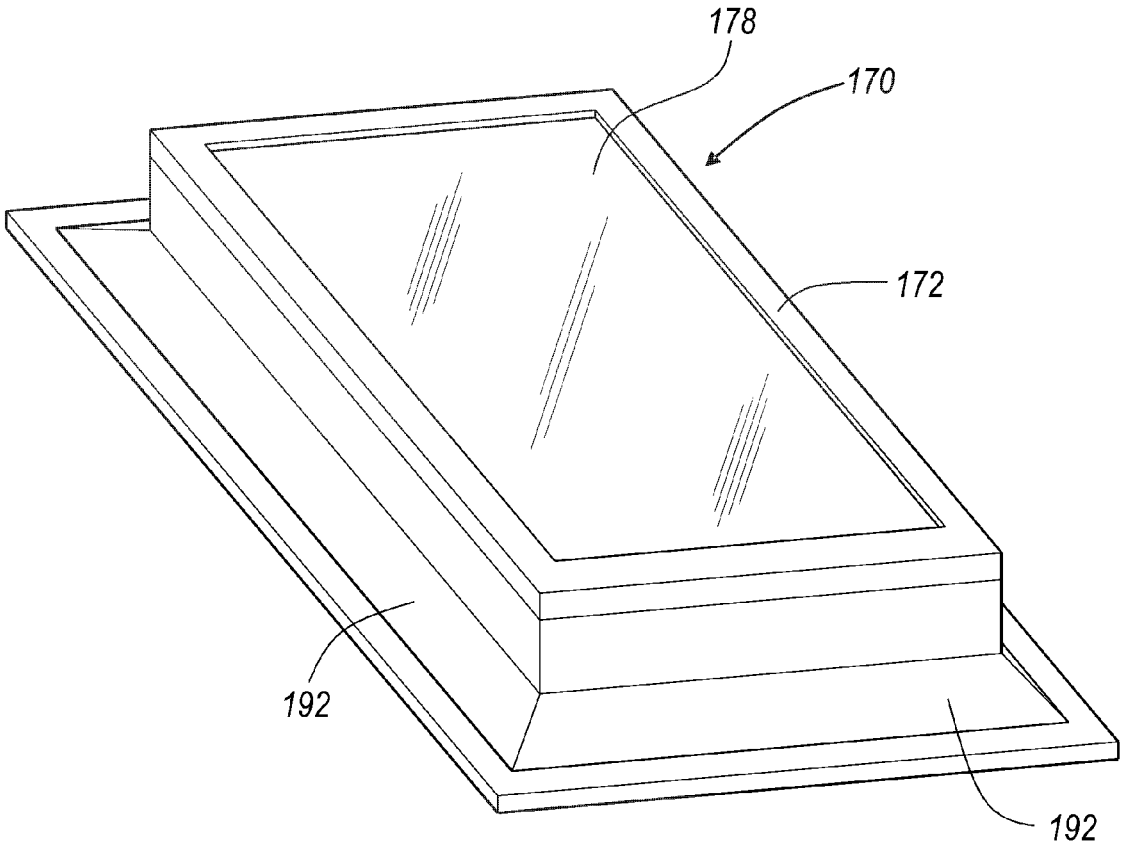
FIG. 10 is a perspective view of a skylight frame-curb assembly of the present invention made by reaction injection molding.

With reference to FIGS. 9 and 10, another embodiment of the present invention in which a skylight frame is molded about an insulating glass is provided. In this embodiment, one or more glass panels are molded into the skylight frame section during formation of the frame. Preferably, this molding operation is a RIM molding process. FIG. 9 provides a cross-sectional view and FIG. 10 provides a top perspective view of the skylight frame assembly of this embodiment. Skylight frame assembly 170 includes frame section 172 which has U-shaped channel 173. U-shaped channel 173 is adapted to hold one or more glass panels. Preferably, a multiglazed window unit will be held in U-shaped channel. Glass panel 176 and glass panel 178 are adhered together by spacer 180 to form a double glassed insulated window unit 182. Bottom surface 184 of U-shaped channel opposes glass surface edge 186 of glass panel 176. Similarly top surface 188 of U-shaped channel oppose glass surface edge 190 of glass panel 178. Bottom surface 184 and top surface 188 in combination with back surface 191 define U shaped channel 173. Finally, the skylight frame assembly of this embodiment optionally includes curb section 192 to facilitate placement of the skylight frame assembly on a roof. To enhance adhesion, glass panels 176, 178 should be cleaned and dried prior to molding of frame 170 around glass panels 176, 178. Moreover, the application of one or more coupling agents prior to molding is found to further enhance adhesion. More preferably, two or more coupling agents are applied to the glass surfaces prior to molding of the skylight frame. Silane coupling agents include vinylsilanes, acryloxy compounds, epoxysilanes, aminosilanes, and organosilane esters. Vinylsilane coupling agents include, for example, vinyltricolosilane, vinyl tris(β-methoxyethoxy) silane, vinyltriethoxysilane. An example of an acryloxy coupling agent is 3-metacryloxypropyl-trimethoxysilane. Examples of epoxysilane coupling agents include for example, β-(3,4 epoxycyclohexyl)-ethyltrimethoxysilane, γ-glycidoxypropyl-trimethoxysilane, and γ-glycidoxypropyl-methylidiethoxysilane. Examples of aminosilane coupling agents include for example, N-β(aminoethyl)-γ-aminopropyl-trimethoxysilane, N-β(aminoethyl)-γ-aminopropyl-methyldimethoxysilane, 3-aminopropyl-triethoxysilane, N-phenyl-γ-aminopropyl-trimethoxysilane. An example of an organosilane ester is methyl triethoxysilane. Other silane coupling agents are γ-mercaptopropyl-trimethoxysilane and γ-chloropropyl-trimethoxysilane. Silane coupling agents are commercially available from Union Carbide Corporation and Mitsubishi International Corporation.

Figure 11:
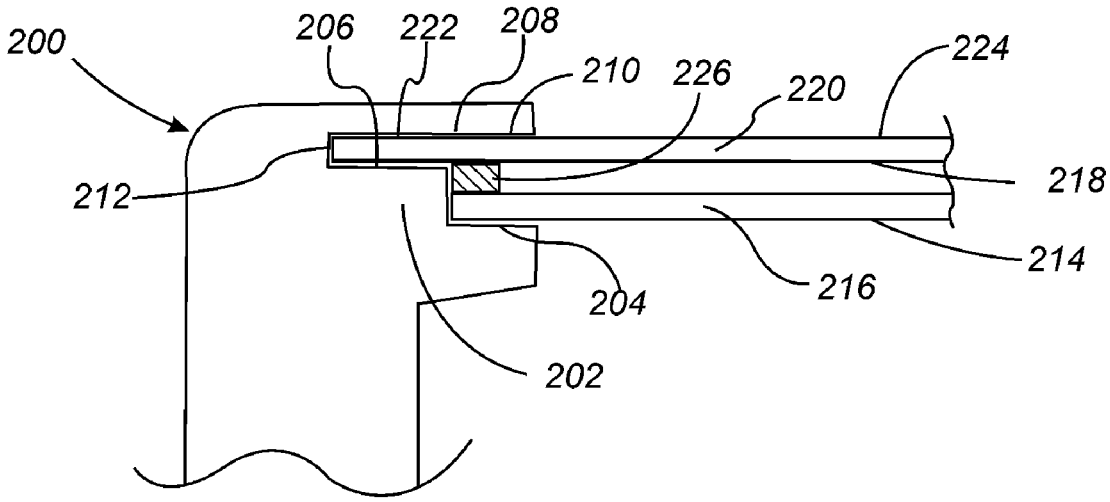
FIG. 11 is a cross-section of a skylight frame-curb assembly of the present invention made by reaction injection molding that has a stepped frame section.

With reference to FIG. 11, a cross-section of a skylight frame with an embedded insulating glass unit having a stepped frame section is provided. Skylight frame section 200 includes stepped frame section 202. Stepped frame section 202 includes lower step surface 204, upper step surface 206, upper channel surface 208. Moreover, skylight frame section 200 includes channel 210 which is defined by upper step surface 206, back surface 212, and upper channel surface 208. Lower step surface 204 opposes glass surface 214 of glass panel 216 and upper step surface 206 opposes glass surface 218 of glass panel 220. Similarly, upper channel surface opposes glass surface 222 of glass panel 220. As set forth above, glass panel 216 and glass panel 220 are combined together in insulated glass unit 224 with a spacer 226. The skylight frame design of this embodiment is advantageously molded around glass panels 216, 220. The preferred method of molding this embodiment is RIM. Again, adhesion is enhanced by cleaning and drying glass plates 216, 220 prior to molding skylight frame 200 followed by application of one or more coupling agents. The preferred coupling agents are the same as those set forth above.

Figure 12:
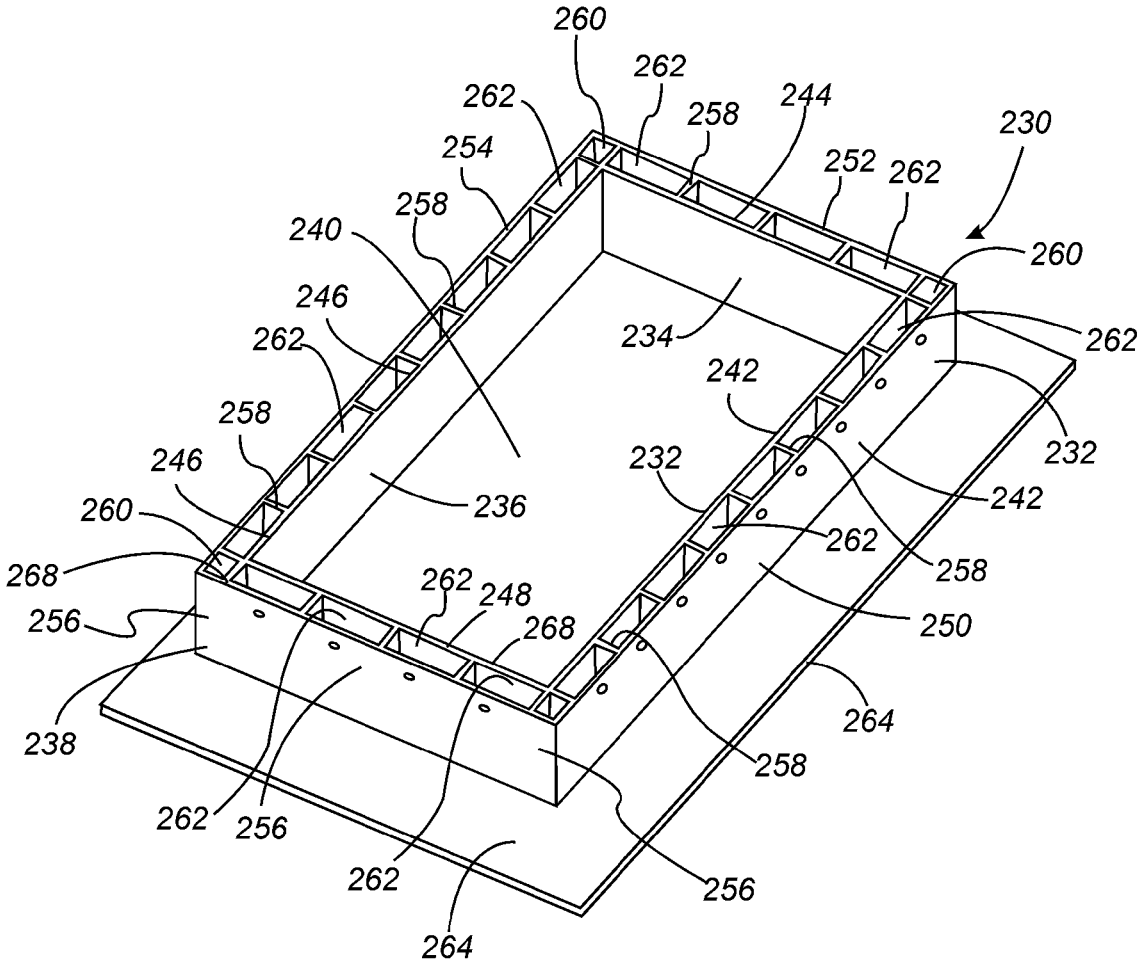
FIG. 12 is a top perspective view of the injection molded skylight curb unit of the present invention.
Figure 13:
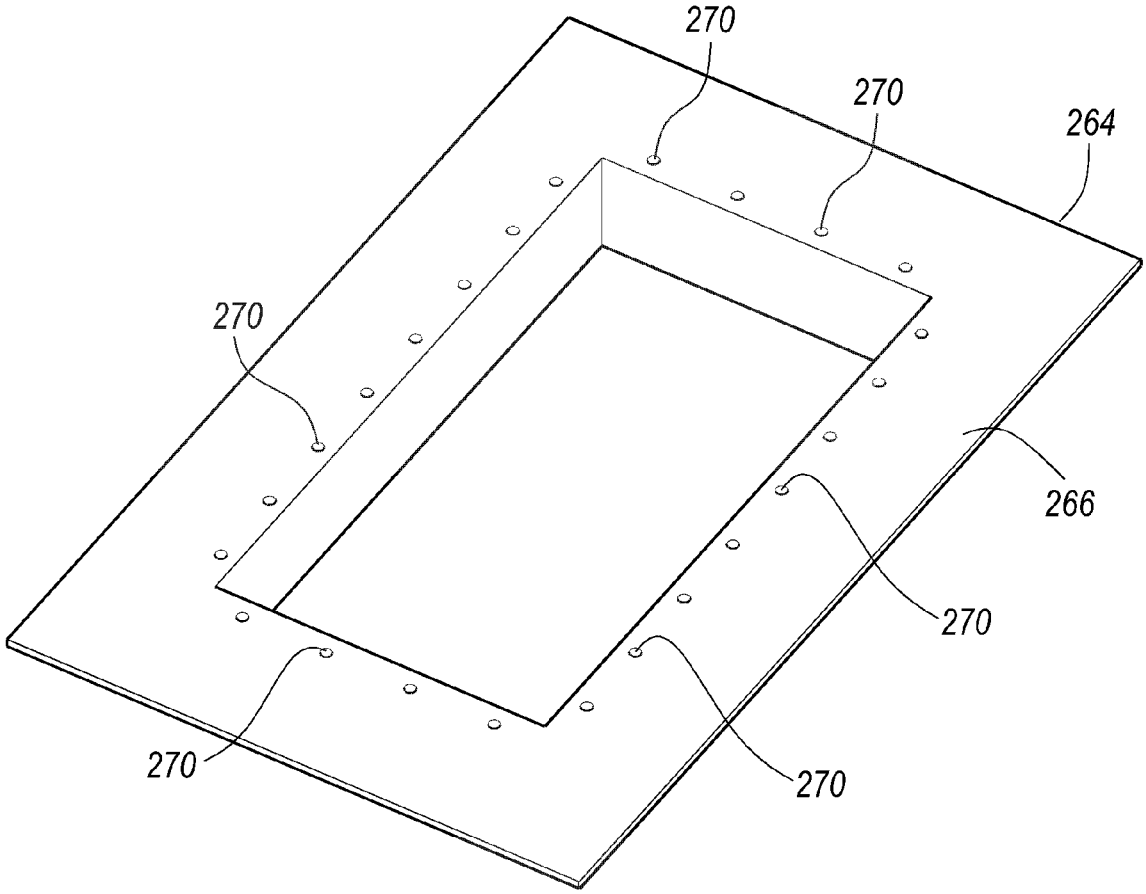
FIG. 13 is a bottom perspective view of the injection molded skylight curb unit of the present invention.

With reference to FIGS. 12 and 13, a skylight curb unit adaptable to a skylight frame is illustrated. FIG. 12 is a top perspective view and FIG. 13 is a bottom perspective view of the skylight curb unit of this embodiment. The skylight curb unit is preferably made of a plastic or rigid polymer by injection molding. Skylight curb unit 230 includes curb sides 232, 234, 236, 238 that define substantially rectangular or square opening 240. Curb sides 232, 234, 236, 238 include interior walls 242, 244, 246, 248 and exterior walls 250, 252, 254, 256. Rigidity is provided to the curb unit by rib network that includes ribs 258 that connect to interior walls 242, 244, 246, 248 and exterior walls 250, 252, 254, 256. The rib network in conjunction with interior walls 242, 244, 246, 248 and exterior walls 250, 252, 254, 256 defines slots 260, 262. Flexible apron 264 extends outwardly from curb sides 232, 234, 236, 238 to provide bottom surface 266 that is adapted to be placed on a rooftop. Top surface 268 of curb unit 230 is adapted to receive a skylight frame unit. Optionally, a gasket and/or a sealant is placed on top surface 268 for this purpose. Bottom surface 266 includes a plurality of bolt holes 270 to receive bolts used to attach the skylight curb unit to a roof. These bolts are passed through slots 260, 262 for this purpose. Moreover, apron 264 may be flashed to a roof by methods known to those in the art of skylight installation. The curb unit of this embodiment is preferably made by injection molding with a thermoplastic resin. Suitable thermoplastic resins include, for example, polyvinylchloride, polyethylene, polypropylene, or nylon.

Figure 14:
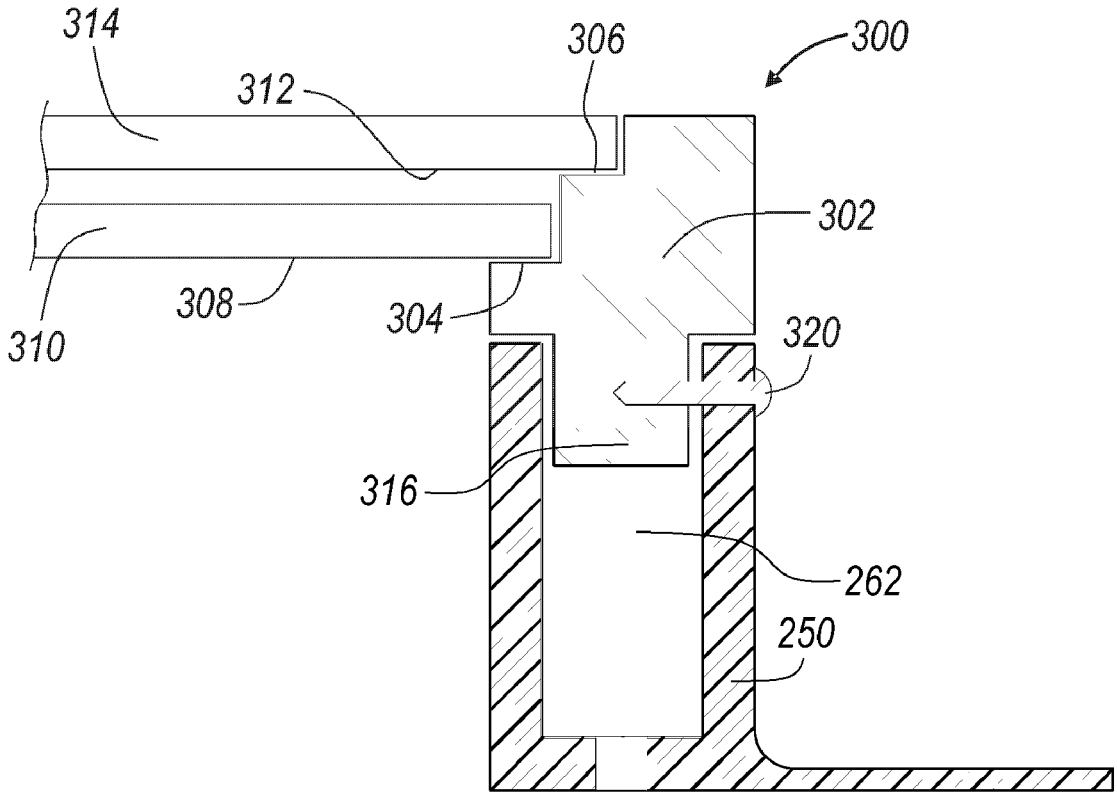
FIG. 14 is cross-sectional view of an integrated skylight frame unit with a bottom cap section inserted into the skylight curb unit of FIGS. 12 and 13.
Figure 15:
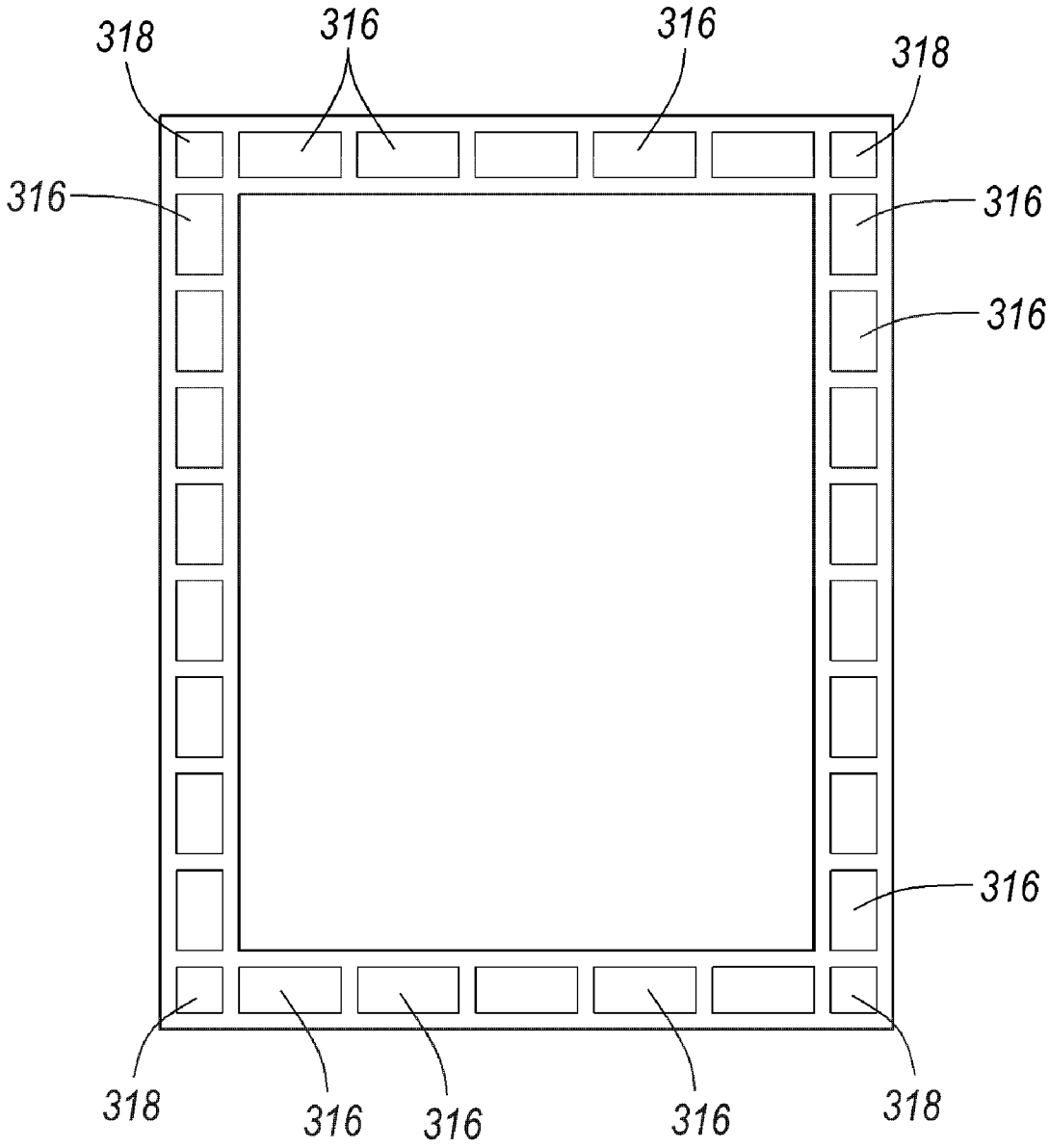
FIG. 15 is a bottom view of an integrated skylight frame unit with a bottom cap section.

With reference to FIGS. 14 and 15, a skylight frame unit adapted be attached to the curb unit of FIGS. 12 and 13 is described. FIG. 14 is a cross-sectional view of the skylight frame unit with a bottom cap section inserted into the skylight curb unit of FIGS. 12 and 13. FIG. 15 is a bottom view of the skylight frame unit of this embodiment. Skylight frame 300 includes stepped frame section 302. The details of stepped frame section 302 are the same as those set forth above for FIGS. 1 and 2. Stepped frame section 302 includes lower step surface 304 and an upper step surface 306. Lower step surface 304 is adapted to receive glass surface 308 of glass panel 310 and upper step surface 306 is adapted to receive glass surface 312 of glass panel 314. Skylight frame 300 also includes insert sections 316 and 318 which are adapted to slide into slots 260, 262 of the skylight curb unit described in FIGS. 12 and 13. Skylight frame 300 is held in place by screw 320 which passes through wall 250 into insert section 316. Alternatively, a pin may be used instead of screw 320.

In still another embodiment of the present invention, a method of forming the skylight frame described above in FIGS. 1-3 is provided. The method of this embodiment comprises extruding a plastic channel with a stepped frame section integral to the plastic channel having a lower step surface and upper step surface; cutting the plastic channel to form a first frame side, a second frame side, a third frame side, and a fourth frame side; and combining the first frame side, the second frame side, the third frame side, and the fourth frame side together to form the skylight frame. The details of the stepped frame section and curb section if present are the same as set forth above for FIGS. 1-4. Moreover, the plastic channel preferably comprises a plastic selected from the group consisting of polyvinylchloride, polyethylene, polypropylene, or nylon.

Figure 16A:
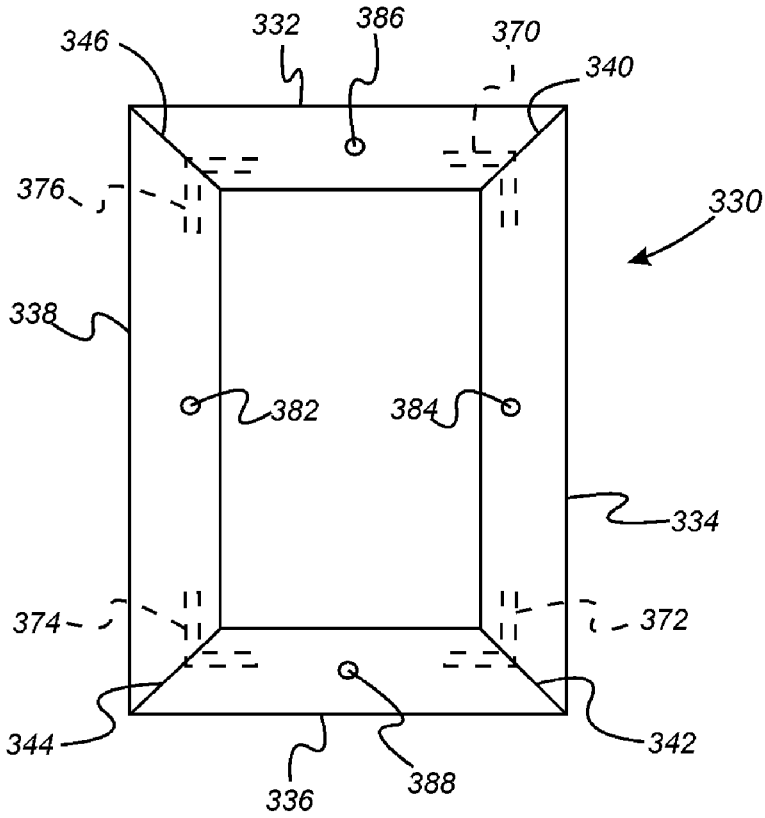
FIG. 16A is a bottom view of a skylight frame-curb assembly constructed from four mitered sides.
Figure 16B:
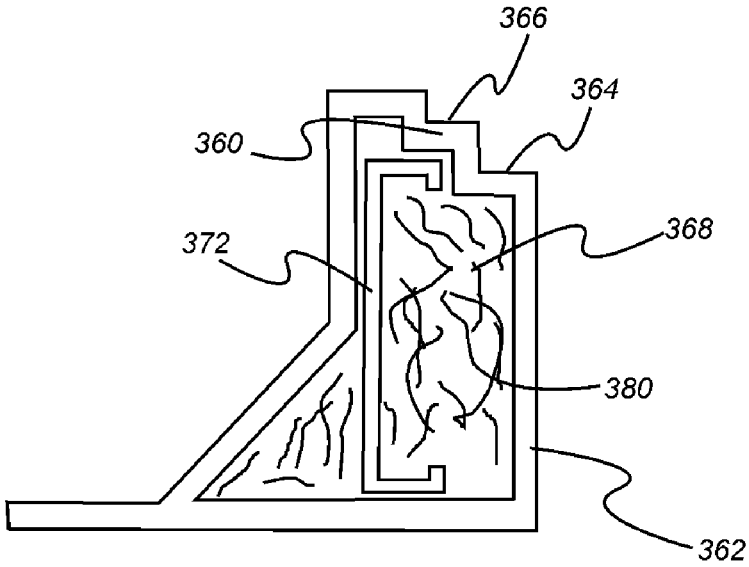
FIG. 16B is a cross-sectional through one of the sides of the skylight frame-curb assembly described by FIG. 16A.

With reference to FIGS. 16A and 16B, a skylight frame assembly constructed from four sides is illustrated. FIG. 16A is a bottom view of a skylight frame-curb assembly constructed from four sides, while FIG. 16B is a cross section through one of the sides when the skylight frame assembly includes a curb section. Skylight frame-curb assembly 330 is assembled from sides 332, 334, 336, 338 which have been cut from an extruded channel. Sides 332, 334, 336, 338 are mitered together as beveled joints 340, 342, 344, 346. Sides 332, 334, 336, 338 include frame step section 360 and curb section 362. Frame step section 360 includes lower step surface 364 and upper step surface 366 which is similar to the frame step section of FIGS. 1-3. Moreover, sides 332, 334, 336, 338 include hollow cavity 368. Optionally, angular inserts 370, 372, 374, 376 are placed within sides 332, 334, 336, 338 as the sides are joined together. This inserts provide rigidity and support to the skylight frame-curb assembly and may extend into hollow cavity 368 for any length desired. Beveled joints 340, 342, 344, 346 are welded together to form a leak tight seal. Suitable processes for this welding include, for example, conventional plastic welding with a heat source and a plastic welding rod, laser welding, and solvent bonding. Optionally, hollow cavity 368 is filled with foamed plastic 380 which is introduced into hollow cavity 368 through inlet holes 382, 384. Vent holes 386, 388 provide a venting path while the foamed plastic is added. The assembly of the skylight frame-curb assembly set forth in this embodiment may be applied the fabrication of the skylight curb assembly of FIGS. 1-3. Similarly, the present embodiment may be applied to the fabrication of the skylight frame of FIG. 4 except that the four sides do not have an integral curb section.

In still another embodiment of the present invention, a method of forming the skylight frame-curb assembly described above in FIG. 5 is provided. The method of this embodiment comprises extruding a plastic U-shaped channel with a stepped frame section integral to the plastic channel having a lower step surface and upper step surface. The details of the stepped frame section and the cross section of the U-shaped channel are the same as set forth above for FIG. 5.

Figure 17:
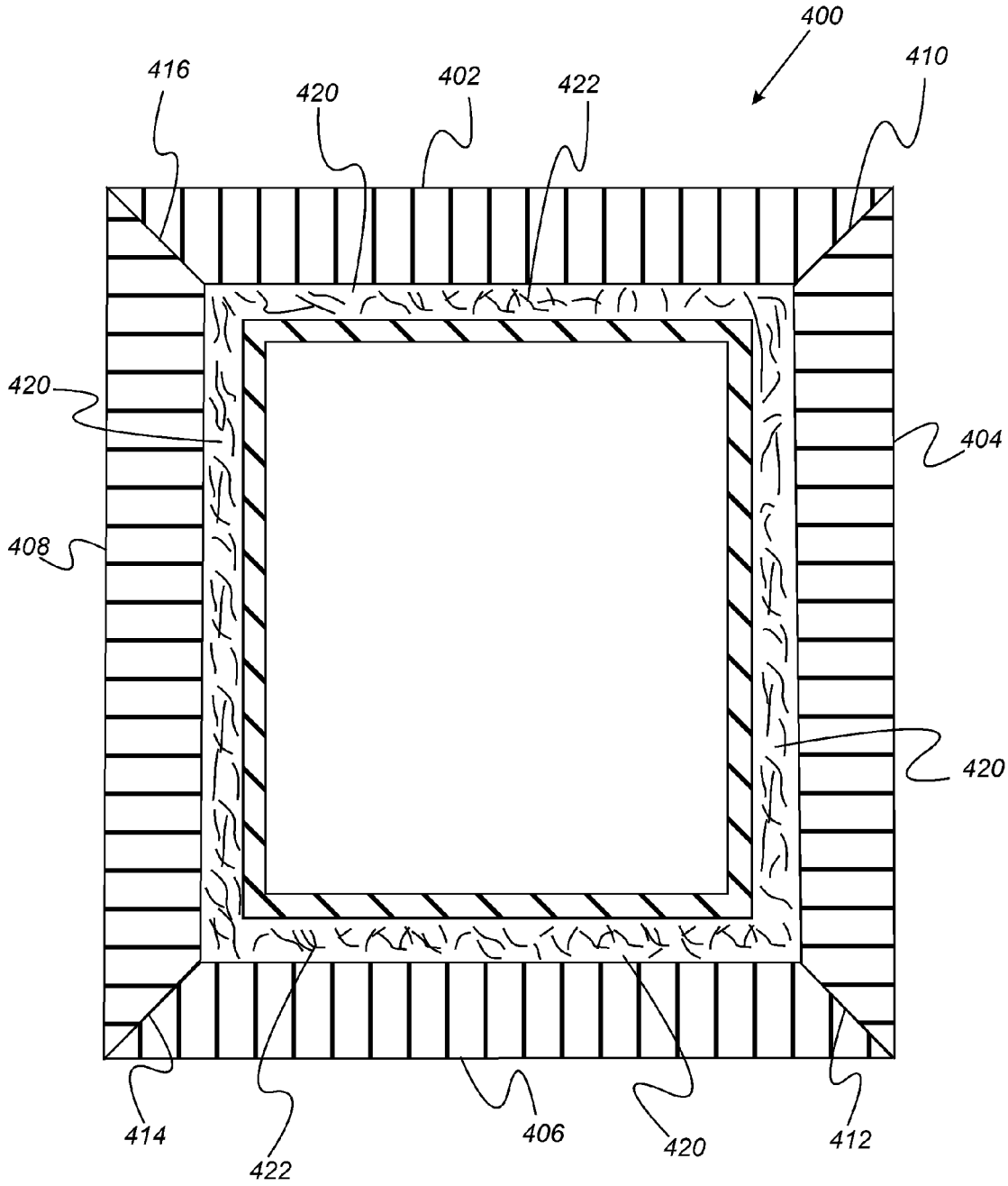
FIG. 17 is a bottom view of a skylight frame-curb assembly constructed from four sides with a with a U-shaped channel.

With reference to FIG. 17, a bottom view of a skylight frame assembly with a U-shaped channel constructed from four sides is illustrated. Skylight frame-curb assembly 400 is assembled from sides 402, 404, 406, 408 which have been cut from an extruded U-shaped channel. Sides 402, 404, 406, 408 are mitered together as beveled joints 410, 412, 414, 416. Sides 402, 404, 406, 408 includes a stepped frame section and curb section (not shown) as set forth for FIG. 5. Sides 402, 404, 406, 408 include U-shaped trough 420. Beveled joints 410, 412, 414, 416 are welded together to form a leak tight seal. Suitable processes for this welding include, for example, conventional plastic welding with a heat source and a plastic welding rod, laser welding, and solvent bonding. Optionally, U-shaped trough 420 is filled with foamed plastic 422.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A skylight frame comprising: a first glass panel having a first length and a first width; a second glass panel having a second length and a second width, wherein the first length is less than the second length and the first width is less than the second width; a spacer disposed between the first glass panel and the second glass panel; and a stepped frame section having a lower step surface, a first substantially vertical surface, an upper step surface, a second substantially vertical surface, and an upper channel surface, the first substantially vertical surface being continuous with the lower step surface and the upper step surface, the second substantially vertical surface being continuous with the upper step surface and the upper channel surface and opposing the spacer, the lower step surface opposing a surface of the first glass panel, the second step surface opposing a first surface of the second glass panel, and the upper channel surface opposing a second surface of the second glass panel such that a peripheral section of the second glass panel is sandwiched between the second step surface and the upper channel surface wherein the first substantially vertical surface, the upper step surface, the second substantially vertical surface, and the upper channel surface are defined within a single unitary component and wherein the second step surface is positioned outside relative to the first step surface.

2. The skylight frame assembly of claim 1 wherein the first glass panel and the second glass panel are laminated together.

3. The skylight frame assembly of claim 1 wherein the first glass panel and the second glass panel are part of an insulated glass unit wherein the first glass panel and the second glass panel are separated by an edge spacer which together with the first glass panel and the second glass panel defines a sealed central cavity between the first glass panel and the second glass panel.

4. The skylight frame assembly of claim 3 wherein the stepped frame section corresponds to edge detail and thickness of the insulated glass unit.

5. The skylight frame assembly of claim 3 wherein the sealed central cavity is at least partially filled with argon or krypton.

6. The skylight frame assembly of claim 1 wherein the skylight frame comprises wood, metal, or plastic.

7. The skylight frame assembly of claim 1 wherein one or more surfaces of the first glass panel or the second glass panel comprise a thin film upon the one or more surfaces.

8. The skylight frame assembly of claim 1 wherein the skylight frame comprises one or more internal surfaces that define a hollow cavity.

9. The skylight frame assembly of claim 8 further comprising a foamed material within the hollow cavity.

10. The skylight frame assembly of claim 9 wherein the foamed material is a foamed plastic.

11. The skylight frame assembly of claim 1 wherein the skylight frame is formed by injection molding, vacuum molding, compression molding, or reaction injection molding.

12. The skylight frame assembly of claim 1 wherein the skylight frame comprises a plastic selected from the group consisting of polyvinylchloride, polyethylene, polypropylene, or nylon.

13. The skylight frame assembly of claim 1 further comprising an integral curb section adapted to be placed on a rooftop.

14. The skylight frame assembly of claim 1 further comprising a frame mating surface adapted to be placed on a curb unit.

* * * * *